US007028856B2

(12) United States Patent
Laundry et al.

(10) Patent No.: US 7,028,856 B2
(45) **Date of Patent: *Apr. 18, 2006**

(54) CRANE CONTROL APPARATUS AND METHOD

(75) Inventors: Bradford B. Laundry, Henrietta, NY (US); Li-te Liu, Rochester, NY (US); Gustavo Montemayor, Troy, NY (US); Dan O. Popa, Troy, NY (US); Michael K. Taylor, Marion, NY (US); John T. Wen, Rensselaer, NY (US)

(73) Assignee: Gorbel, Inc., Fishers, NY (US)

( * ) Notice: Subject to any disclaimer, the term of this patent is extended or adjusted under 35 U.S.C. 154(b) by 362 days.

This patent is subject to a terminal disclaimer.

(21) Appl. No.: 10/636,725

(22) Filed: Aug. 7, 2003

(65) Prior Publication Data

US 2004/0155004 A1 Aug. 12, 2004

Related U.S. Application Data

(63) Continuation-in-part of application No. 10/068,640, filed on Feb. 6, 2002, now Pat. No. 6,796,447.

(60) Provisional application No. 60/267,850, filed on Feb. 9, 2001.

(51) Int. Cl.
*B66C 13/06* (2006.01)

(52) U.S. Cl. ..... 212/328; 212/270

(58) Field of Classification Search ..... 212/275, 212/285, 328, 330, 270

See application file for complete search history.

(56) References Cited

U.S. PATENT DOCUMENTS

| | | | | |
|---|---|---|---|---|
| 2,940,608 | A * | 6/1960 | Underwood et al. | 212/287 |
| 4,163,929 | A * | 8/1979 | Janu et al. | 318/628 |
| 5,350,075 | A | 9/1994 | Kahlman | 212/159 |
| 5,850,928 | A | 12/1998 | Kahlman et al. | 212/285 |
| 5,915,673 | A | 6/1999 | Kazerooni | 254/270 |
| 6,204,619 | B1 * | 3/2001 | Gu et al. | 318/568.11 |
| 6,204,620 | B1 * | 3/2001 | McGee et al. | 318/568.11 |
| 6,299,139 | B1 | 10/2001 | Kazerooni | |
| 6,386,513 | B1 | 5/2002 | Kazerooni | 254/270 |
| 6,796,447 | B1 * | 9/2004 | Laundry et al. | 212/275 |

OTHER PUBLICATIONS

"Human Assisted Impedance Control of Overhead Cranes", J.T. Wen, D.O. Popa, G. Montemayor, and P.L. Liu, presented at the CCA (Conference on Control Applications), Mexico City, Sep. 2001.

"Intelift Air Balancers", Ingersoll-Rand web site, Intelift control handle, Jan. 30, 2001.

* cited by examiner

*Primary Examiner*—Thomas J. Brahan
(74) *Attorney, Agent, or Firm*—Brown & Michaels, PC

(57) ABSTRACT

This crane control apparatus and method with swing control and variable impedance is intended for use with overhead cranes where a line suspended from a moveable hoist suspends a load. It is responsive to operator force applied to the load and uses a control strategy based on estimating the force applied by the operator to the load and, subject to a variable desired load impedance, reacting in response to this estimate. The human pushing force on the load is not measured directly, but is estimated from measurement of the angle of deflection of the line suspending the load and measurement of hoist position.

34 Claims, 4 Drawing Sheets

CRANE CONTROL APPARATUS AND METHOD

RELATED APPLICATIONS

This application is a Continuation-In-Part of allowed U.S. patent application Ser. No. 10/068,640, filed 6 Feb. 2002 now U.S. Pat. No. 6,796,447, entitled CRANE CONTROL SYSTEM, and PCT/US02/03687, filed 7 Feb. 2002, entitled CRANE CONTROL SYSTEM. Priority is also claimed to Provisional Patent Application No. 60/267,850, filed on 9 Feb. 2001, which provisional application is incorporated by reference herein.

TECHNICAL FIELD

Overhead and jib cranes that can be driven to move a lifted load in a horizontal direction.

BACKGROUND

Suggestions have been made for power-driven cranes to move a hoisted load laterally in response to manual effort applied by a worker pushing on the lifted load. A sensing system determines from manual force input by a worker the direction and extent that the load is desired to be moved, and the crane responds to this by driving responsively to move the lifted load to the desired position. Examples of such suggestions include U.S. Pat. No. 5,350,075 and 5,850,928 and Japanese Patent JP2018293.

A problem encountered by such systems is a pendulum effect of the lifted load swinging back and forth. For example, when the crane starts moving in a desired direction, the mass of the load momentarily lags behind. It then swings toward the desired direction. A sensing system included in the crane can misinterpret such pendulum swings for worker input force. This can result in the crane driving in one direction, establishing a pendulum swing in the opposite direction, sensing that as a reverse direction indicator, and driving in the opposite direction. This results in a dithering motion. In effect, by misinterpreting pendulum swings as worker input force, the crane can misdirect the load in various ways that are not efficient or ergonomically satisfactory. Prior attempts at arriving at an inventive solution to this problem have focused on suppressing oscillations of the load while the crane is accelerating or decelerating.

SUMMARY OF THE INVENTION

We consider swing suppression to be secondary. In our view, it is more important to control the impedance felt by the operator pushing on the hoisted load. Thus, we have developed an inventive solution that uses a control strategy based on estimating the force applied by the operator to the load and, subject to a variable desired load impedance, reacting in response to this estimate. The human pushing force is not measured directly, but it is estimated from angle and position measurements. In effect, our control strategy places the human operator in the outer control loop via an impedance block that is used in making trajectory generalizations.

DRAWINGS

Figure 3:
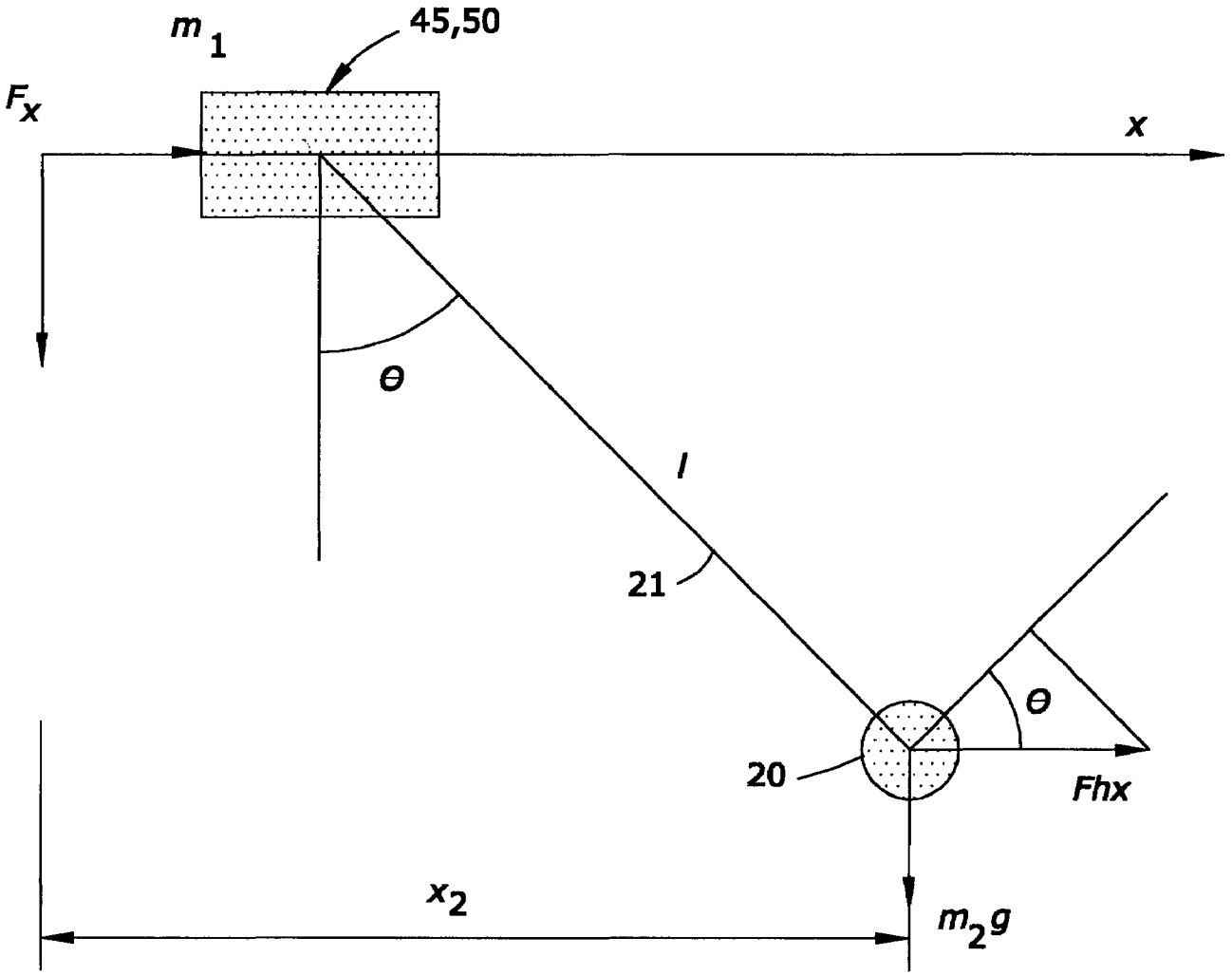

FIG. 3 provides a first schematic view of the pendulum-like features of the hoist/load system.

Figure 4:
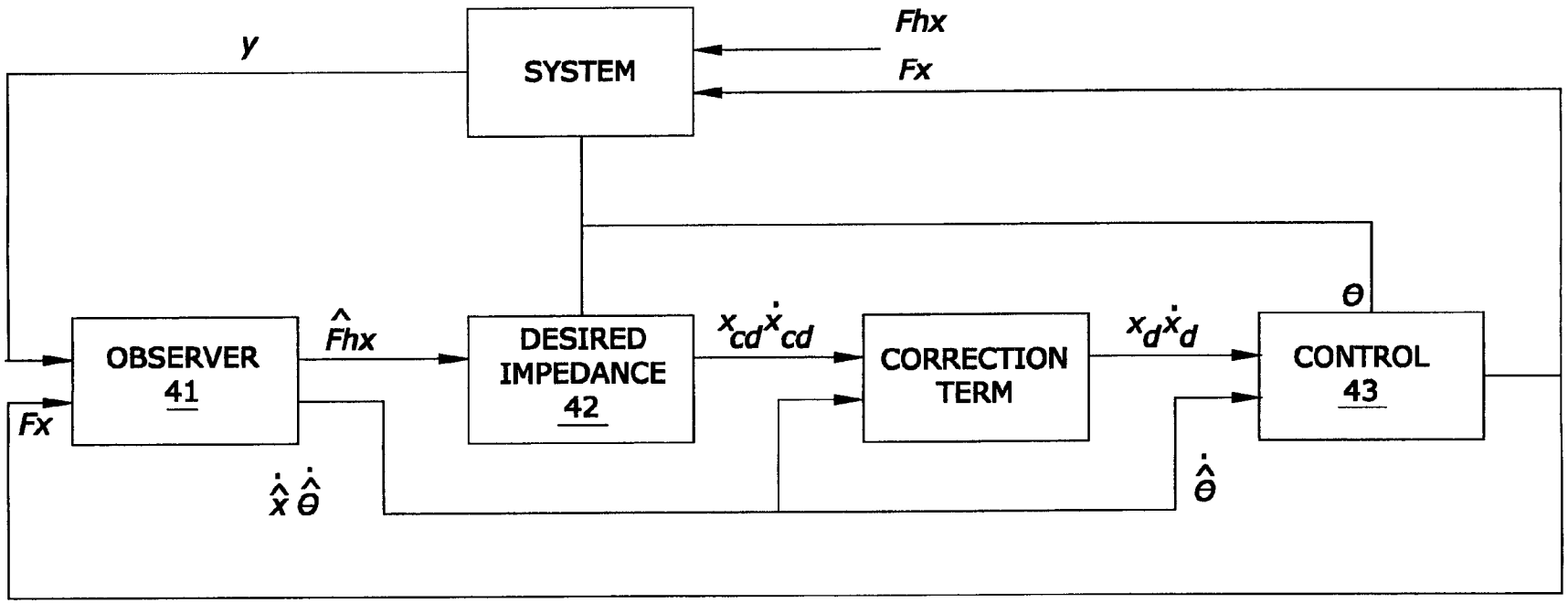

FIG. 4 provides a schematic control system diagram for this invention.

Figure 5:
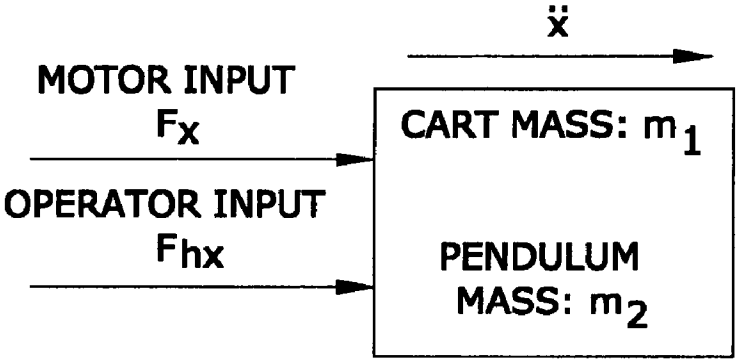

FIG. 5 provides a unified schematic view of the hoist/load linear system.

Figure 6:
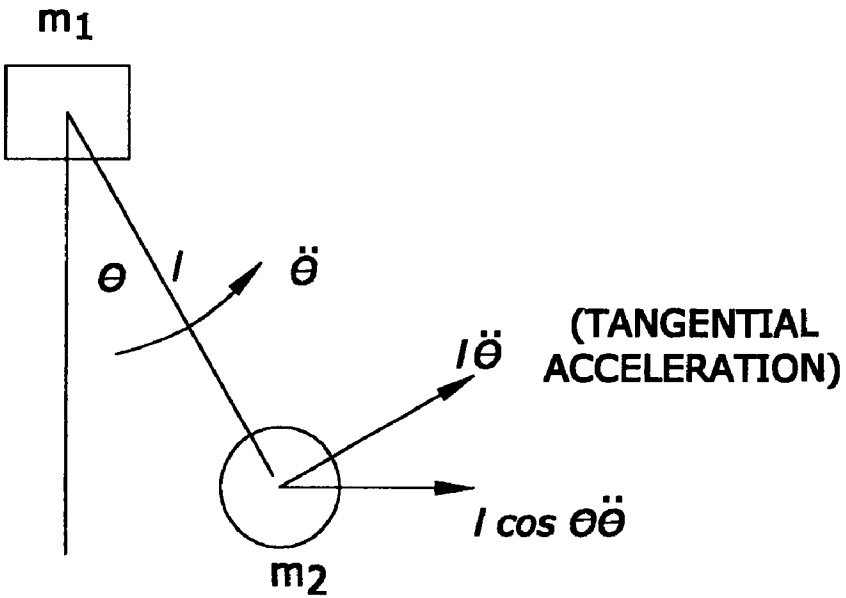

FIG. 6 provides a second schematic view illustrating the pendulum-like features of the hoist/load system.

DETAILED DESCRIPTION

1. General Physical System Description

Figure 2:
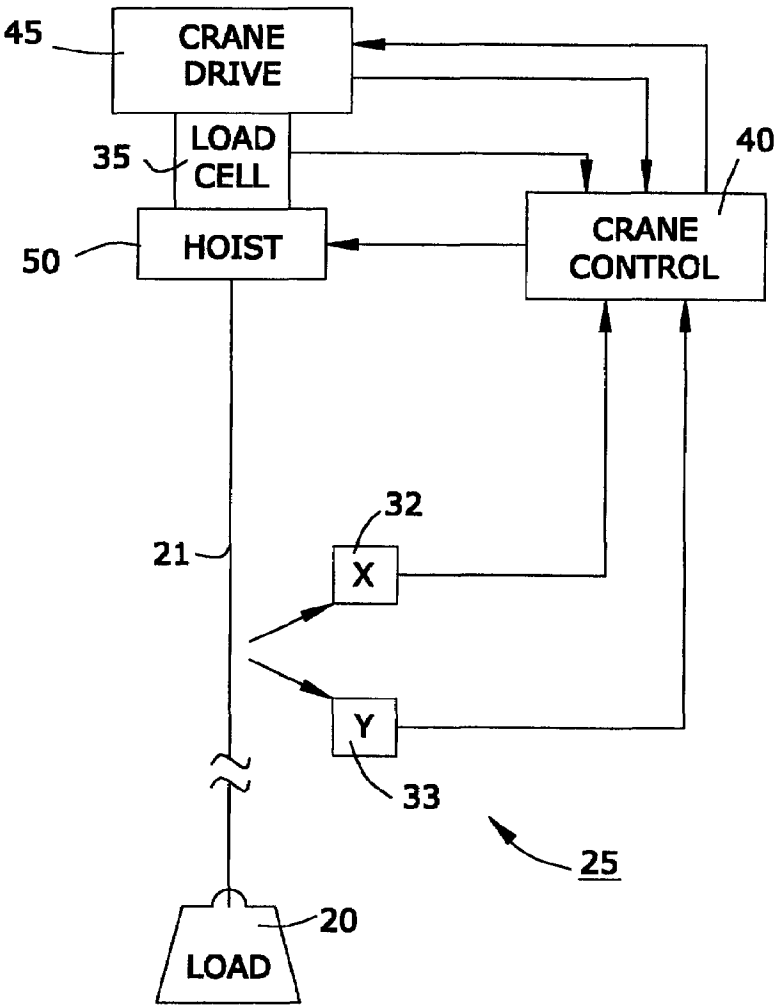
FIG. 2 is a schematic diagram providing additional detail regarding an arrangement of sensors suitable for use with this invention.
Figure 1:
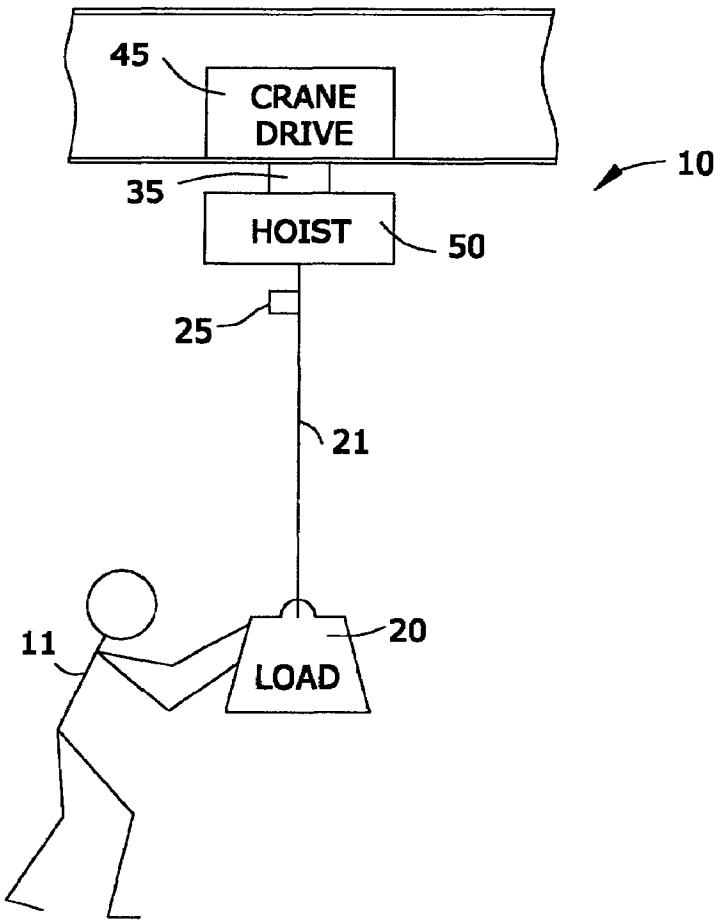
FIG. 1 is a schematic view illustrating the general form of a crane system of the type used with this invention.

FIGS. 1 and 2 illustrate a crane system 10 with a hoist 50 supporting a lifted load 20. An operator 11 pushing on load 20 as illustrated can urge load 20 in a desired direction of movement. Sensors 25 are arranged to sense the direction and angle by which line 21 is deflected due to operator 11 pushing on load 20. Crane system 10 then responds to input force by operator 11 and uses crane drive 45 to drive sensors 25 and hoist 50 to the desired location for lowering load 20.

Crane drive 45 is typically a hoist trolley controlled by crane control 40. However, it could also be a moveable crane bridge controlled by crane control 40. Sensors 25 constitute a x sensor 32 and a y sensor 33 arranged perpendicular to each other to respectively sense x and y direction swing movements of load 20. Sensors 32 and 33 can have a variety of forms including mechanical, electromechanical, and optical. Preferences among these forms include linear encoders, optical encoders, and electrical devices responsive to small movements. Sensors 32 and 33 are connected with crane control 40 to supply both amplitude and directional information on movement sensed. Where it is important for crane control 40 to know the mass of any load 20 involved in the movement, the force or mass of load 20 is preferably sensed by a load cell or strain gauge 35 intermediate crane drive 45 and hoist 50. However, other possibilities can also be used, such as a load sensor incorporated into or suspended below hoist 50. The location/position of hoist 50 can be supplied to crane control 40 using means well known in the art.

As previously noted, a control software system for crane control 40 receives data of the type specified above and actuates crane drive 45, which moves the crane trolley and/or bridge in the direction indicated by the worker. Since load 20 is supported on cable 21 suspended from hoist 50, load 20 and cable 21 act as a pendulum swinging below hoist 50. As drive 45 in crane 10 moves load 20 horizontally in response to force input from worker 11, pendulum effects of load 20 and hoist 50 can occur in addition to desired-direction-of-movement-force input by worker 11. The control software system of crane control 40 must be able to deal with this problem as well as with the general problem of responding appropriately to force input from worker 11.

2. Mathematical Description of the System

The problems arising from the pendulum effects of load 20 can be dealt with more easily by considering each axis of motion to be decoupled—i.e.—as if the motion of the x and y axes are independent. Each axis can then be modeled separately, as in FIG. 3, as a simple pendulum with a point of support that changes its position along the specified axis. The system on each axis contains a load 20 with mass ($m_2$) attached through cable 21 to the crane drive 45 and hoist 50 (which is treated as a mass $m_1$) that can move along the horizontal axis. The nonlinear model for the x axis subsystem is given by:

$$M(q)\ddot{q} + C(q, \dot{q})\dot{q} + G(q) + F_r(\dot{q}) = \tau \quad (1)$$

where:

$$M(q) = \begin{bmatrix} (m_1 + m_2) & m_2 l\cos(\theta) \\ m_2 l\cos(\theta) & m_2 l^2 \end{bmatrix}$$

$$C(q, \dot{q}) = \begin{bmatrix} 0 & -m_2 l\sin(\theta)\dot{\theta} \\ 0 & 0 \end{bmatrix}$$

$$G(q) = \begin{bmatrix} 0 \\ m_2 gl\sin(\theta) \end{bmatrix}$$

$$F_r(\dot{q}) = \begin{bmatrix} b_1\mathrm{sgn}(\dot{x}) + b_2\dot{x} \\ b_\theta\dot{\theta} \end{bmatrix}$$

$$\tau = \begin{bmatrix} F_x + F_{hx} \\ lF_{hx}\cos(\theta) \end{bmatrix}$$

$$q = \begin{bmatrix} x \\ \theta \end{bmatrix}$$

where I is the cable length, θ is the angle of the cable, $b_2$ is the viscous damping along the x axis, $b_1$ is the static friction along the x axis, $b_\theta$ denotes the viscous joint damping, $F_x$ is the force applied to $m_1$ via crane drive 45 in response to signals received from crane control 40, and $F_{hx}$ is the force applied to the load 20 by worker 11.

Substituting each matrix element into (1), leads to the two equations of motion (EOM) for the two generalized coordinates, position x and angle θ.

$$x\text{: } (m_1+m_2)\ddot{x}+m_2 l\cos\theta\ddot{\theta}-m_2 l\sin\theta\dot{\theta}^2=F_x+F_{hx}-b_2\dot{x}-b_1\mathrm{sign}(\dot{x})$$

$$\theta\text{: } m_2 l\cos\theta\ddot{x}+m_2 l^2\ddot{\theta}+m_2 gl\sin\theta=l\,F_{hx}\cos\theta-b_\theta\dot{\theta}$$

where $\dot{x}$, $\ddot{x}$, $\dot{\theta}$, $\ddot{\theta}$ refer to the linear velocity, linear acceleration, angular velocity, and angular acceleration respectively.

a. The Linear Equation of Motion

The "X" equation of motion can be most easily understood by approaching the cart-pendulum system as a unified system. This system can be described using Newton's second law as $(m_1+m_2)\ddot{x}=F_{x+F_{hx}}$. However, since $m_2$ is also rotating with an angular acceleration, it induces an active force onto the entire motion as well. (See, FIG. 6.) As the X equation of motion only deals with motion along the x-axis, the corresponding acceleration term with mass based on Newton's second law is then equal to $m_2 l\cos\theta\ddot{\theta}$. The $-m_2 l\sin\theta\dot{\theta}^2$ term represents an interesting pseudo-force: the Coriolis force. Imagine when θ=0, the load 20 ($m_2$) rotates at a peak tangential velocity of $l\dot{\theta}$. However, as θ increases, the velocity along the x-axis gets smaller in a similar manner to that of the acceleration. It is as if an opposing force is reducing the velocity. This force is analytically represented by the aforesaid negative term. Finally $-b_2\dot{x}-b_1\,\mathrm{sgn}(\dot{x})$ shows the opposing frictional forces on the system which is typically modeled as a viscous friction proportional to the velocity, and a coulomb friction that remains constant and against the direction of movement using sgn() to represent the direction of motion.

b. The Angular Equation of Motion

The θ equation of motion is simpler. Refer back to FIG. 6 and the equation $m_2 l\cos\theta\ddot{x}+m_2 l^2\ddot{\theta}+m_2 gl\sin\theta=l\,F_{hx}\cos\theta-b_\theta\dot{\theta}$. Imagine that you are standing at the center of $m_1$, and looking at $m_2$. It's as if only load 20 ($m_2$) is rotating. Using Newton's second law in the torque version $T=m_2\ddot{\theta}$, we have $l\,F_{hx}\cos\theta=m_2 l^2\ddot{\theta}'m_2 gl\sin\theta$ with $m_2 gl\sin\theta$ as the resisting torque from the gravity effect on $m_2$. As the system is frictionous, the input torque is compensated by $-b\dot{\theta}$. This is the viscous joint damping friction. Finally we must remember that since the entire system is accelerating at $\ddot{x}$, $m_2$ in effect is also traveling at that rate. Thus, if $m_1$ suddenly slows down while the ball is still linearly moving at that original acceleration, you can expect $m_2$ to rise up and this effect is described by the $m_2 l\cos\theta\ddot{x}$ term, which again follows Newton's second law.

c. Conclusion

Expressing (1) in the form $\dot{X}=f(X,u)$, with $X=[x, \theta, \dot{x}, \dot{\theta}]^T$ we have that:

$$\dot{X} = \begin{bmatrix} \dot{x} \\ \dot{\theta} \\ M^{-1}(q)(Uu - C(q, \dot{q})\dot{q} - g(q) - F_r(\dot{q})) \end{bmatrix} \quad (2)$$

where $U = \begin{bmatrix} 1 & 1 \\ 0 & l\cos(\theta) \end{bmatrix}$ and $u = [F_x F_{hx}]^T$ so $$\ddot{x} = \eta m_2 l(l(F + F_h - b_1\mathrm{sgn}(\dot{x}) - b_2\dot{x} + - F_h\cos(\theta)^2) + m_2 l^2\dot{\theta}^2\sin(\theta) + b_\theta\dot{\theta}\cos(\theta) + + m_2 gl\cos(\theta)\sin(\theta))$$

$$\ddot{\theta} = \eta(m_2 l(-(F - b_1\mathrm{sgn}(\dot{x}) - b_2\dot{x})\cos(\theta) + - m_2 l\dot{\theta}^2\cos(\theta)\sin(\theta) - (m_1 + m_2)g\sin(\theta)) + + m_1 lF_h\cos(\theta) - (m_1 + m_2)b_\theta\dot{\theta})$$

$$\text{where } \eta = \frac{1}{m_2 l^2(m_1 + m_2\sin^2(\theta))}$$

Linearizing the equation (2) around $X^*=(x, \mathbf{0}, \mathbf{0}, \mathbf{0})^T$ we obtain:

$$\dot{X} = AX + Bu = AX + [B_1 \mid B_2]u \quad (3)$$

where $$A = \left[\begin{array}{c|ccc} 0_{2\times 2} & & I_2 & \\ \hline 0 & \frac{m_2 g}{m_1} & -\frac{b_2}{m_1} & \frac{b_\theta}{m_1 l} \\ 0 & -\frac{(m_1 + m_2)g}{m_1 l} & \frac{b_2}{m_1 l} & -\frac{(m_1 + m_2)b_\theta}{m_1 m_2 l^2} \end{array}\right]$$

$$B = \left[\begin{array}{c|c} 0_{2\times 2} & \\ \hline \frac{1}{m_1} & 0 \\ -\frac{1}{m_1 l} & \frac{1}{m_2 l} \end{array}\right]$$

The measured states are the cable angle θ and the position x of $m_1$. Therefore, the output of the system is given by Y=CX, $$C = \begin{bmatrix} 1 & 0 & 0 & 0 \\ 0 & 1 & 0 & 0 \end{bmatrix} \quad (4)$$

A simple rank check shows that this nominal control system is both controllable and observable.

3. Description of Control System

A schematic control system diagram for control 40 is shown in FIG. 4. In this implementation, each axis of movement is controlled independently, so we would usually use two crane controls with the same structure but with different parameters and settings. As a simplification, we only reference crane control 40 for the x-axis in the understanding that all the descriptions would also apply to a y axis control. This system is also based on the assumption that the force $F_{hx}$ applied by operator 11 to load 20 ($m_2$) is not available through direct measurement and that the only input available are the position of $m_1$ and the cable angle, i.e.—x and θ. Based on this information, the system illustrated in FIG. 4 provides control input via control 40 resulting in the application of an appropriate force $F_x$ to $m_1$ via crane drive 45.

As can be seen in FIG. 4, a linear observer block 41 is used to obtain an estimate of the force $F_{hx}$. The dynamic equations of the observer block 41 are given by:

$$\dot{\hat{X}} = A_e\hat{X} + B_eF_x + LC_e(y - \hat{y});\ y = [x, \theta]^T \tag{5}$$

$$\text{where: } \hat{X} = \left[\hat{x}, \hat{\theta}, \dot{\hat{x}}, \dot{\hat{\theta}}, \hat{F}_{hx}\right]^T$$

$$A_e = \begin{bmatrix} A \mid B_2 \\ --+-- \\ 0 \mid 0 \end{bmatrix};\ B_e = B_1$$

$$C_e = \begin{bmatrix} 1 & 0 & 0 & 0 & 0 \\ 0 & 1 & 0 & 0 & 0 \end{bmatrix}$$

This system is also controllable and observable. The pushing force $F_x$ applied on the mass $m_1$ is given by:

$$F_x = \begin{cases} F_x - F_{combx};\ |F_{combx}| \langle b_{ls} \text{ and } |\dot{\hat{x}}| \langle \varepsilon \\ F_x - b_1\ \text{sgn}(\dot{\hat{x}});\ \text{otherwise} \end{cases} \tag{6}$$

where:

$$F_{combx} = F_x - b_2\dot{\hat{x}} + \frac{b_\theta}{l}\dot{\hat{\theta}} + m_2 g\theta \tag{7}$$

$b_{1s}$ is the stiction on the x-axis and $\epsilon>0$. Equations (6) and (7) describe the static friction compensation for the observer block 41, taking into account two cases:

(1) The static case when $m_1$ is at rest and the observer block 41 is that of a simple pendulum; and (2) the case when $m_1$ is moving and the static friction is just subtracted from the control input $F_x$.

In addition to the pushing force estimate, the observer block 41 also generates filtered values for the cart position, velocity, cable angle and angular velocity.

We use the estimated operator force to generate the desired position of the load by passing it through a desired impedance block 42:

$$M_d\ddot{x}_{cd} + B_d\dot{x}_{cd} = \hat{F}_h \tag{8}$$

where $M_d$ is the desired mass, $B_d$ is the desired damping and $X_{cd}$ is the desired position of the load. Through the impedance block 42 we can specify a particular performance for the motion of the load 20. At the same time, the "feel" of the load for the worker 11 can be changed from very light with almost no damping, to heavy and viscous with extreme damping.

Since we don't have direct control on the position of the load 20, but on the position of $m_1$, we use a correction block 44 to calculate the term $x_{cd}$ and $\dot{x}_{cd}$ by:

$$x_d = x_{cd} + l \sin\theta \tag{9}$$

$$\dot{x}_d = \dot{x}_{cd} + \dot{\theta} l \cos(\theta) \tag{10}$$

where $x_d$ is the desired position of $m_1$.

The control block 43 we employ is a simple pole-placement controller, which is used to track the reference trajectory $x_d = [X_d, 0, \dot{x}_d, 0]^T$. There are a variety of other controllers that can be used here. Therefore, anti-swing is achieved with desired load impedance, if $$F_x = K_1(x_d - x) - K_2\theta + K_3(\dot{x}_d - \hat{x}) - K_4\hat{\theta} \tag{11}$$

where $K_i$, i=1, 2, 3, 4 are given by specific locations of the system poles.

In actual experimental implementation we have had to deal with the uncertainties in the parameters of the system, the variation of the friction along the runways for crane drive 45, the change of length of the cable 21, inaccuracies in the measurements of the angle θ, etc. All these differences between the model and the real system generate a non-zero observer force $\hat{F}_{hx}$ that can drive the crane in the absence of a pushing force. To fix this problem we used dead zones for some signals such as:

The angle of the wire, θ.

The estimated force applied to the loads $\hat{F}_{hx}$.

The control signal $F_X$.

The thresholds for these dead zones are also a function of the angular velocity, such that there is a larger dead zone band when the load 20 is swinging without any force applied to it, and a lower value when the load 20 is stationary and the operator 11 is applying a force to it.

Our invention presents a viable means for dealing with the problem of controlling an overhead crane using an estimation of the force applied to the load. Using a linearized system, a controller-observer was designated using the placement of the closed-loop poles for both the system and the observer. The controller structure was tested in both numerical simulations and then using an experimental setup. Due to parametric uncertainties and disturbances in the dynamical model of the system we used dead zones on the estimated applied force ($\hat{F}_h$), the angle of the wire (θ, ϕ) and on the control signal (F). With the use of these nonlinear elements, we could work with a simple model of the system and yet obtain a relatively clean estimate of the force $F_h$.

We performed tests with different loads and different cable lengths as well as with a constant load 20 and a constant length cable 21, and experimentally confirmed that the controller system is robust to variations to both $m_2$ and I.

We claim:

1. A crane control apparatus for controlling lateral movement of a hoist for a line bearing a load where operator force applied to the load in a lateral direction causes angular deflection of the line, comprising:

sensing apparatus providing hoist position and angle of deflection measurements; and a crane control that receives said measurements and can cause the hoist to move in a particular manner as a function of estimated operator force applied to the load without direct measurement of operator force applied to the load, which estimated operator force is derived from said measurements.

2. A crane control apparatus as described in claim 1, wherein a linear observer is used by said crane control to obtain estimated operator applied force.

3. A crane control apparatus as described in claim 2, wherein said linear observer also generates filtered values for hoist position and velocity.

4. A crane control apparatus as described in claim 2, wherein said linear observer also generates filtered values for line angle of deflection and angular velocity.

5. A crane control apparatus as described in claim 1, wherein the manner in which said crane control causes the hoist to move is also a function of a desired impedance that influences the responsiveness of the crane control and can be used to damp load swing.

6. A crane control apparatus as described in claim 5, wherein said desired impedance is adjustable and thereby provides variable damping of load swing.

7. A crane control apparatus as described in claim 1, wherein said function further includes a desired impedance that influences the responsiveness of the crane control and can be used to control the amount of inertia experienced by the operator in moving the load.

8. A crane control apparatus as described in claim 7, wherein said desired impedance is adjustable such that operator experienced inertia is variable.

9. A crane control apparatus as described in claim 1, wherein estimated operator force is used to generate the desired position of the load by passing it through a desired impedance block.

10. A crane control apparatus as described in claim 1, wherein a correction block is used to calculate the desired position of the hoist and the change in its desired position over time.

11. A crane control apparatus as described in claim 1, wherein a pole-placement controller is used to track a reference trajectory.

12. A crane control apparatus as described in claim 1, wherein a pole-placement controller assists in damping load swing.

13. A crane control apparatus as described in claim 1, wherein a linear observer uses said measurements to generate an estimated operator force applied to the load, and a desired impedance block uses the estimated operator force applied to the load to generate the desired position of the load.

14. A crane control apparatus as described in claim 13, wherein the desired impedance block generates the desired position of the load based on the following formula:

$$M_d\ddot{x}_{cd}+B_d\dot{x}_{cd}=\hat{F}_h$$

where $\hat{F}_h$ is estimated operator force applied to the load, $M_d$ is the desired mass, $B_d$ is the desired damping and $X_{cd}$ is the desired position of the load.

15. A crane control apparatus as described in claim 14, wherein a correction block is used to calculate the terms $X_{cd}$ and $\dot{x}_{cd}$ where $X_d$ is the desired position of the hoist based on the following formulae:

$$x_d=x_{cd}+l\sin\theta.$$

$$\dot{x}_d=\dot{x}_{cd}+\dot{\theta}l\cos(\theta$$

16. A crane control apparatus as described in claim 15, wherein a pole placement controller is used to track the reference trajectory $X_d=[x_d, 0, \dot{x}_d, 0]^T$.

17. A crane control apparatus as described in claim 16, wherein anti-swing is achieved with a desired load impedance, when $F_x=K_1(x_d-x)-K_2\theta+K_3(\dot{x}_d-\hat{\dot{x}}_d)-K_4\hat{\dot{\theta}}$ where $K_i$, i=1,2,3,4 are given by specific locations of the system poles.

18. A crane control method for controlling lateral movement of a hoist for a line bearing a load where operator force applied to the load in a lateral direction causes angular deflection of the line, comprising:

providing sensing apparatus and a crane control, which sensing apparatus provides hoist position and angle of deflection measurements to said crane control, and which crane control receives said measurements and can cause the hoist to move in a particular manner as a function of estimated operator force applied to the load without direct measurement of operator force applied to the load, which estimated operator force is derived from said measurements; and causing the hoist to move in a particular manner using said crane control.

19. A crane control method as described in claim 18, wherein a linear observer is used by said crane control to obtain estimated operator applied force.

20. A crane control method as described in claim 19, wherein said linear observer also generates filtered values for hoist position and velocity.

21. A crane control method as described in claim 19, wherein said linear observer also generates filtered values for line angle of deflection and angular velocity.

22. A crane control method as described in claim 18, wherein the manner in which said crane control causes the hoist to move is also a function of a desired impedance that influences the responsiveness of the crane control and can be used to damp load swing.

23. A crane control method as described in claim 22, wherein said desired impedance is adjustable and thereby provides variable damping of load swing.

24. A crane control method as described in claim 18, wherein said function further includes a desired impedance that influences the responsiveness of the crane control and can be used to control the amount of inertia experienced by the operator in moving the load.

25. A crane control method as described in claim 24, wherein said desired impedance is adjustable such that operator experienced inertia is variable.

26. A crane control method as described in claim 18, wherein estimated operator force is used to generate the desired position of the load by passing it through a desired impedance block.

27. A crane control method as described in claim 18, wherein a correction block is used to calculate the desired position of the hoist and the change in its desired position over time.

28. A crane control method as described in claim 18, wherein a pole-placement controller is used to track a reference trajectory.

29. A crane control method as described in claim 18, wherein a pole-placement controller assists in damping load swing.

30. A crane control method as described in claim 18, wherein a linear observer uses said measurements to generate an estimated operator force applied to the load, and a desired impedance block uses the estimated operator force applied to the load to generate the desired position of the load.

31. A crane control method as described in claim 30, wherein the desired impedance block generates the desired position of the load based on the following formula:

$$M_d\ddot{x}_{cd}+B_d\dot{x}_{cd}=\hat{F}_h$$

where $\hat{F}_h$ is estimated operator force applied to the load, $M_d$ is the desired mass, $B_d$ is the desired damping and $X_{cd}$ is the desired position of the load.

32. A crane control method as described in claim 31, wherein a correction block is used to calculate the terms $X_{cd}$ and $\dot{x}_{cd}$ where $X_d$ is the desired position of the hoist based on the following formulae:

$$x_d = x_{cd} + l \sin \theta$$

$$\dot{x}_d = \dot{x}_{cd} + \dot{\theta} l \cos (\theta.$$

33. A crane control method as described in claim 32, wherein a pole placement controller is used to track the reference trajectory $X_d = [x_d, 0, \dot{x}_d, 0]^T$.

34. A crane control method as described in claim 33, wherein anti-swing is achieved with a desired load impedance, when $F_x = K_1(x_d - x) - K_2\theta + K_3(\dot{x}_d - \dot{x}_d) - K_4\dot{\theta}$ where $K_i$, i=1,2,3,4 are given by specific locations of the system poles.

* * * * *